United States Patent [19]

Holden, deceased et al.

[11] 4,314,794

[45] Feb. 9, 1982

[54] TRANSPIRATION COOLED BLADE FOR A GAS TURBINE ENGINE

[75] Inventors: Abe N. Holden, deceased, late of Broomall, Pa.; by Joyce A. Holden, executrix, Half Moon Bay, Calif.

[73] Assignee: Westinghouse Electric Corp., Pittsburgh, Pa.

[21] Appl. No.: 88,245

[22] Filed: Oct. 25, 1979

[51] Int. Cl.[3] ..... F01D 5/18

[52] U.S. Cl. ..... 416/97 A; 416/225; 416/241 B

[58] Field of Search ..... 416/97 A, 97 R, 225, 416/241 B; 415/115

[56] References Cited

U.S. PATENT DOCUMENTS

| | | | |
|---|---|---|---|
| 3,067,982 | 12/1962 | Wheeler | 416/97 A |
| 3,240,468 | 3/1966 | Watts et al. . | |
| 3,301,526 | 1/1967 | Chamberlain | 416/97 R |
| 3,402,914 | 9/1968 | Kump et al. . | |
| 3,457,619 | 7/1969 | Kydd . | |
| 3,515,499 | 6/1970 | Beer et al. | 416/97 A |
| 3,619,077 | 11/1971 | Wile et al. | 416/97 |
| 3,635,587 | 1/1972 | Glesman | 416/97 |
| 3,781,129 | 12/1973 | Aspinwall | 416/97 |
| 3,846,041 | 11/1974 | Albani | 416/97 |
| 3,872,563 | 3/1975 | Brown et al. | 416/97 |
| 4,221,539 | 9/1980 | Corrigan | 416/97 A |

*Primary Examiner*—Robert E. Garrett

[57] ABSTRACT

A transpiration cooled blade for a gas turbine engine is assembled from a plurality of individual airfoil-shaped hollow ceramic washers stacked upon a ceramic platform which in turn is seated on a metal root portion. The airfoil portion so formed is enclosed by a metal cap covering the outermost washer. A metal tie tube is welded to the cap and extends radially inwardly through the hollow airfoil portion and through aligned apertures in the platform and root portion to terminate in a threaded end disposed in a cavity within the root portion housing a tension nut for engagement thereby. The tie tube is hollow and provides flow communication for a coolant fluid directed through the root portion and into the hollow airfoil through apertures in the tube. The ceramic washers are made porous to the coolant fluid to cool the blade via transpiration cooling.

10 Claims, 5 Drawing Figures

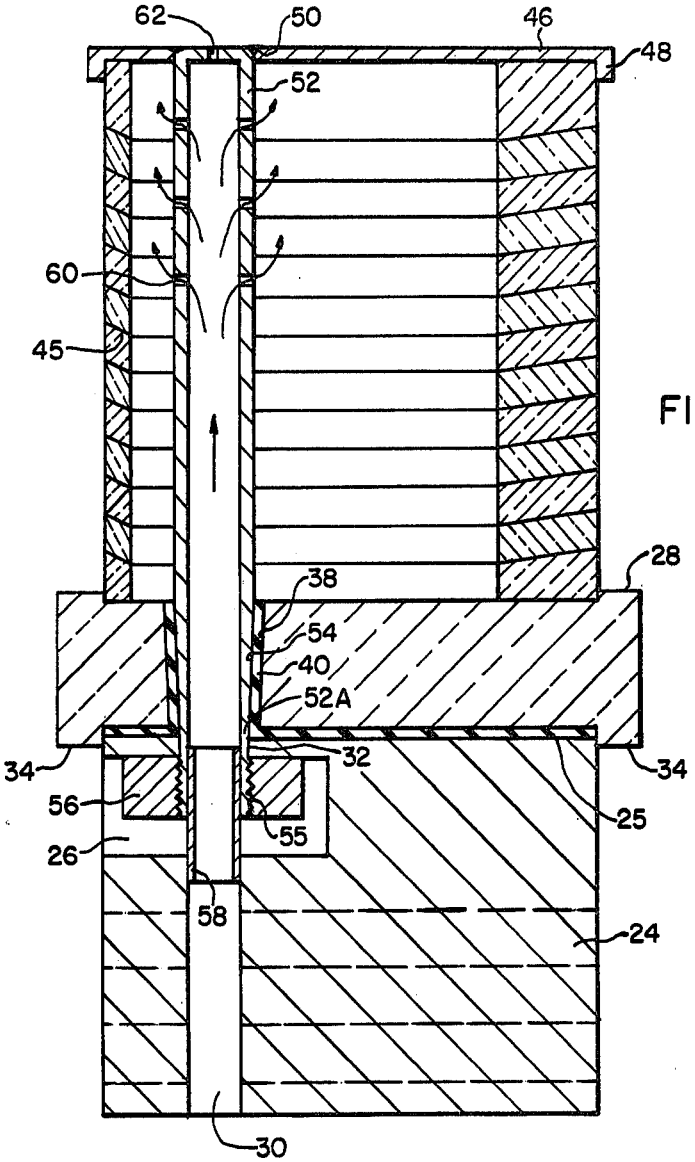
FIG. 2.
FIG. 3.
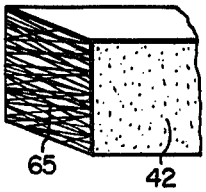
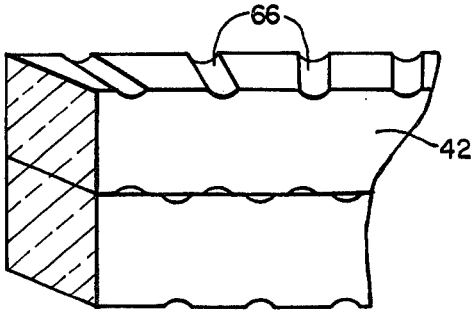
FIG. 4.
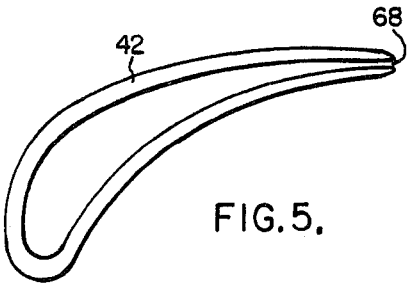
FIG. 5.

TRANSPIRATION COOLED BLADE FOR A GAS TURBINE ENGINE

BACKGROUND OF THE INVENTION

1. Field of the Invention

This invention relates to cooled turbine blades and more particularly to a transpiration cooled blade having a ceramic airfoil portion.

2. Description of the Prior Art

Cooled turbine blades are well known in the art. One means of blade cooling offering great potential is referred to as transpiration cooling and is accomplished by introducing a cooling fluid into a hollow airfoil portion of the blade, with the skin of the airfoil portion being porous through minute passages for the effusion of the fluid therethrough. This cools the blade by transporting the heat within the blade to the fluid and further, the fluid provides a boundary layer on the exterior of the blade surface preventing the hot motive gases from direct contact therewith. As effective as such cooling is however, in the projected range of temperatures of operation necessary to obtain 50 to 55% efficiency for a gas turbine engine (turbine inlet temperatures must then approach 2500° to 3000° F.) the high temperature alloys from which most blades are fabricated tend to oxidize and the minute transpiration flow paths thus become plugged.

In view of the above, the use of ceramic blades is actively being investigated. However, ceramic (i.e. $Si_3N_4$ and SiC) have limited strength in tension and also tend to glassify at faults and erode at high temperature. Therefore, even though the ceramics permit a higher turbine inlet temperature, it would be preferable to provide cooling to such ceramic blades to reduce the probability of their failure at these temperatures. Thus, transpiration cooled ceramic blades offer a solution to permitting a turbine inlet temperature in the range of 3000° F. One such blade is disclosed in U.S. Pat. No. 3,240,468 wherein, to relieve internal stress due to thermal gradients across the blade, a different amount of cooling fluid is directed to separate portions of the cooled blade. Further, in that the present invention involves a blade assembled from a plurality of stacked washers forming the airfoil portion of the blade, U.S. Pat. Nos. 3,301,526 and 3,515,499 are relevant for showing a prior art turbine vane comprising a plurality of airfoil-shaped wafers stacked to form a cooled vane.

SUMMARY OF THE INVENTION

The present invention provides a composite blade wherein the airfoil portion is fabricated from a plurality of separate airfoil-shaped hollow ceramic washers. The washers are stacked radially upon a separate ceramic platform and capped by a metal cap overlying the outermost washer to form a hollow blade. A hollow metal tie tube is welded to the cap and extends downwardly through the ceramic airfoil portion and through an aperture in the platform into a cavity in a separate metal root portion on which the platform is seated. The end of the tube in this cavity is threaded for receipt of a tension or lock nut to tension the tube and place a compressive force on the ceramic components. The tie tube also contains apertures in the portion passing through the airfoil portion providing a cooling fluid outlet for the cooling fluid received in the tube disposed within the root portion. The ceramic washers are, through any various means such as machining or etching, made porous so that the coolant fluid flows therethrough for transpiration cooling. Thus the individual pieces provide stress relief; the metal cap, tie tubes, and root permit a compressive force to be placed on the ceramic washers with the tensile force being accommodated by the metal components which are protected from high temperature environments; and, the ceramic washers provide a ceramic part usually fabricated either through machining or hot pressing that can also easily be made porous.

DESCRIPTION OF THE DRAWINGS

FIG. 2 is a cross-sectional radial view through the blade;

FIG. 3 is an enlarged detailed view of the portion circled in FIG. 2 showing transpiration air passages in the ceramic washers;

FIG. 4 is a view similar to FIG. 3 showing machined air passages; and

FIG. 5 is a view showing another configuration of the ceramic washers of the air-foil portion of the blade of the present invention.

DESCRIPTION OF THE PREFERRED EMBODIMENT

Figure 1:
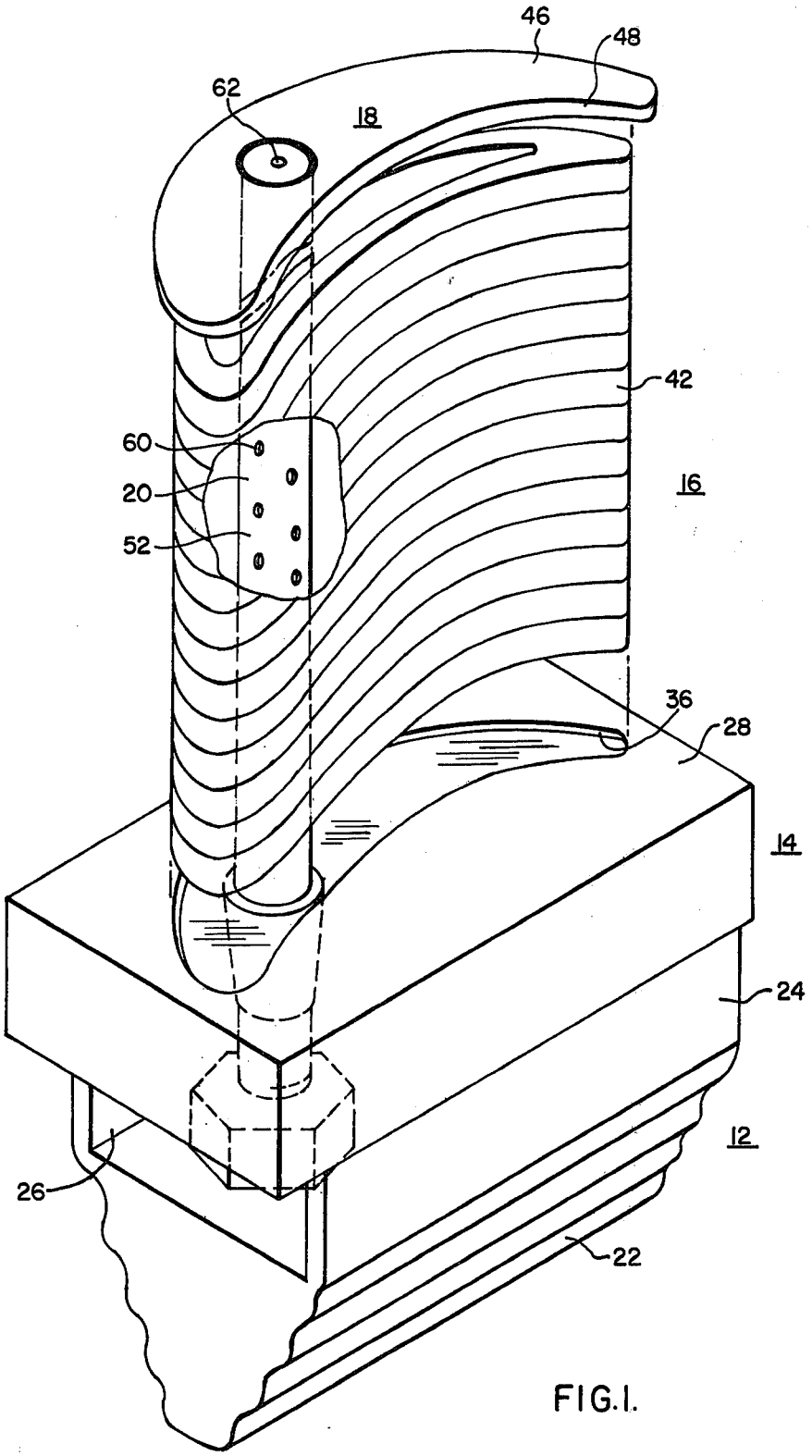
FIG. 1 is an exploded isometric view of the blade of the present invention.

The blade of the present invention is an assembly of individual parts secured together to form the final blade. Thus, referring to FIGS. 1 and 2, the main components comprise a metal root segment 12, a ceramic platform 14, a ceramic airfoil portion 16, a metal blade cap or tip 18, and a metal tie tube 20.

The root segment 12 has a fir-tree configuration 22 for engagement within a complementary groove within a rotor disc of a gas turbine engine, as is well known in the art, and terminates radially outward in a relatively long shank portion 24 having a generally planar top surface 25. The shank portion contains an elongated rectangular channel or cavity 26 extending therethrough adjacent the surface 25. A radially extending air passage 30 extends between the cusp of the root to the channel 26 and a concentric aperture 32 extends between the surface 25 and the channel 26.

The ceramic platform 14 is either a silicon nitrate or silicon carbide ($Si_3N_4$ or SiC) hot pressed for densification to closely approximate the final shape of the platform so that minimal machining or machine finishing is required which is also a feature of the to be described ceramic airfoil portion 16.

The platform 14 is disposed over the surface 25 of the root segment and includes a pair of opposed depending ribs 34 for proper registry of the platform thereon. The upper surface 28 of the platform has a depression 36 conforming to the dimension and configuration of the airfoil portion for receiving the airfoil portion for proper alignment. A downwardly inwardly tapered opening 38, concentric with the aperture 32 in the root portion, extends radially through the platform. A layer of a resilient compliant interface material 40 is disposed between the facing surfaces of the platform and the blade root and also lines the opening 38.

The airfoil portion 16 comprises a plurality of individual ceramic washers 42 (i.e. hollow wafer) each having the proper airfoil configuration such that when radially stacked together the airfoil portion of the blade is formed. The radially facing surfaces 44 of the washers which face adjacent washers are beveled such as at 45 for an interlocking engagement therebetween in the stacked position. As will be explained later, the ceramic washers 42 are porous for the passage of a coolant fluid from the interior of the airfoil portion to the exterior thereof.

An airfoil-shaped metal cap 46 forms the tip 18 of the blade with the periphery thereof defining a depending lip 48 for engaging the outer surface of the radially outermost ceramic washer 42 for proper positioning the cap thereon to enclose the hollow airfoil portion. The cap has an opening 50 for receipt therethrough of one end of a hollow metal, substantially cylindrical, tie tube 52 that extends radially through the hollow airfoil, with the opposite end 52*a* having a downwardly inwardly tapered portion 54 generally mating with the aperture 38 through the ceramic platform and finally terminating in an externally threaded portion 55 extending into the cavity in the shank of the root portion. A tension adjusting nut 56 is threaded thereto for drawing the tie tube radially inwardly as will be explained, and a short metal tube 58 extends from within the tie tube to within the coolant passage in the blade root for a confined flow passage from the root cusp to the tie tube.

It is seen that the portion of the tie tube within the hollow air-foil portion contains a plurality of apertures 60 to direct the coolant into the hollow portion for effusion through the ceramic washers for transpiration cooling. Also a small opening 62 at the radially outermost end of the tie tube permits a portion of the coolant to flow therethrough to cool the metal cap and provide a seal between the cap and adjacent shroud structure to reduce the amount of motive gas flowing across the tip.

From the above description, the assembly of the blade is seen to be as follows: First the compliant material is placed on the undersurface of the platform with a portion lining the opening 38. Next, the ceramic platform is placed on the flat surface 25 of the metal root portion in proper registry as determined by the respective openings being concentric and the lips thereof engaging the edges of the root portion as shown. The threaded end of the metal tie tube having the short extension tube securely engaged thereby is then inserted through the openings to extend into the cavity and a tension nut is threaded thereover and initially tightened to a degree to establish at least a limited rigidity to the thus assembled components. The ceramic washers 42 are then stacked on the platform to form the airfoil portion. The metal cap is next placed over the airfoil portion with the tie tube extending therethrough. It is seen that the outer mating surfaces of the cap and the tie tube are beveled to form a notch about the periphery of the tube. The two metal surfaces, i.e., of the cap and tube, are then welded together to form an integral unit.

The tension adjusting nut is then fully tightened to the preferred torque to place a tension on the tie tube that results in the ceramic pieces, i.e. the washers and the platform, being subjected to a compressive force and also perfecting the seal between the tube and the opening through the platform by the tapered tight engagement with the compliant material.

In such assembled condition any final machining such as the weld on the cap or any irregularities in the stacked airfoil, can then be accomplished after which the blade is ready for assembly to the rotor disc.

Reference is now made to FIGS. 3 and 4 to illustrate alternative means for fabricating the porous ceramic washers.

As it is known to dispose metal fibers or wires in a ceramic forming powder prior to hot pressing the powder and thereafter pressing to form the final ceramic piece, under which conditions the wires predominantly align themselves perpendicular to the pressing direction to enhance the tensile stress characteristics of the ceramic, similar fabrication techniques are used to provide a porous ceramic washer. In the ceramic washer shown in FIG. 3, to result in a porous ceramic washer, up to 20% by volume of a tungsten or tantalum wires about 50% longer than the thickness of the ceramic washer and from about 0.010 to 0.030 inches diameter are mixed with the ceramic powder before hot pressing. During hot pressing these wires will predominantly extend through the wall. Afterwards, the fibers are oxidized out in an air furnace or leached out chemically as either metal forms a highly volatile oxide. Once the wires or fibers are so removed, the resulting ceramic piece is randomly porous as typified by the minute passages 65 in FIG. 3.

FIG. 4 shows a ceramic washer 42 that contains rounded half moon-shaped grooves 66 machined at regularly shaped intervals on its beveled contact surface. These grooves are rounded and have a fairly large radius to minimize stress concentration, especially for thermal transient loads. These machine grooves, extending from the innerface to the outer face provide flow paths through which the cooling fluid can pass.

The ceramic washers 42 can also have a configuration as shown in FIG. 5 wherein the trailing edge of the airfoil configuration has a slit 68 therein for discharging a portion of the cooling fluid through this trailing edge. This configuration is referred to as a clothes-pin shape and it is contemplated that the slit will have a tendency to close when the blade becomes heated during actual use, relieving stress caused by thermal expansion and limiting the amount of coolant flowing therethrough. It is also conceivable that the airfoil portion of the blade could be formed by alternatively stacking the ceramic washers with the ceramic clothes-pins providing greater rigidity and less trailing edge cooling leakage than if formed entirely of the ceramic clothes-pin structure.

Thus it is seen that the blade of the present invention includes ceramic portions which are contacted by the high temperature motive fluid and which are effectively cooled by transpiration cooling to permit an even greater temperature range for the motive gas without causing failure of the ceramic components. Further, the blade is rather easily fabricated and assembled from parts which can be initially formed to their ultimate final shape requiring minimal final machining after assembly and which, by virtue of their independence, inherently relieve stress due to thermal gradients across the surface of the blade. Further, it should be noted that the ceramic components of the blade are maintained in assembled position by a compressive force thereon such that a rather minimal tensile stress, under operating conditions, due to the gas bending load, will be well within the range of the physical strength of the ceramic.

What is claimed is:

1. A blade for a gas turbine engine comprising: a plurality of hollow ceramic washers having an airfoil cross-section and radially stacked upon each other to form the airfoil portion of the blade; a metal cap covering the radially outermost washer and defining the blade tip; a metal blade root defining a shank portion and rotor disc engaging projections; a ceramic platform member interposed between the radially innermost washer and the blade root; a perforated metal tie tube secured to said cap and extending generally radially therefrom through the airfoil portion and radially aligned apertures in the platform and shank portion is terminate within a cavity in said root portion to provide coolant flow communication from within said root to within said air-foil portion; means within said cavity for tensioning said tie tube; and wherein said ceramic washers include coolant flow channels extending therethrough for effusion of the coolant from within the airfoil portion to the external side thereof for transpiration cooling of said airfoil portion of the blade.

2. Structure according to claim 1 wherein the facing surfaces of adjacent ceramic washers are commonly inclined for indexed receipt of each adjacent washer.

3. Structure according to claim 2 wherein the end of the tie tube within said cavity in the root portion is externally threaded and said means for tensioning said tie tube comprises a tensioning nut engaging said threaded end.

4. Structure according to claim 3 wherein said cap defines an opening for exhausting a portion of the coolant at the blade tip for perfecting a sealing effect between the blade tip and adjacent stationary structure of the turbine.

5. Structure according to claim 1 wherein said coolant flow channels comprise grooves formed in the facing surfaces of adjacent ceramic washers.

6. Structure according to claim 1 wherein said coolant flow channels extending through said washers are randomly disposed.

7. A blade assembly for a gas turbine engine, said assembly comprising:

a metal root portion having an elongated shank defining a cavity therein subadjacent the radially outer surface with a first generally radially extending opening between said cavity and said surface;

a ceramic platform member seated on said radially outer surface and having a second opening generally concentric with said first opening;

a plurality of hollow ceramic airfoil-shaped washers, radially stacked upon each other to form the airfoil portion of said assembly, with the radially innermost washer seated on said platform member, a metal cap covering the radially outermost washer and defining the blade tip;

a hollow metal tie tube attached to said cap and extending generally radially inwardly through said airfoil portion and said concentric openings and into said cavity to terminate therein in an externally threaded end; and, means within said cavity for tensioning said tie tube and placing a compressive force on said washers and platform; and wherein, said tie tube is in flow communication with a coolant fluid and includes apertures in that length within said airfoil portion for exhausting said fluid into said airfoil portion; and wherein said washers define coolant flow channels for effusion of the coolant fluid from within the airfoil portion to the exterior thereof for transpiration cooling of the ceramic airfoil.

8. An assembly according to claim 7 wherein the facing surfaces of adjacent ceramic washers define complementary indexing configurations for indexed receipt of each adjacent washer.

9. Structure according to claim 7 wherein said coolant flow channels comprise grooves formed in the facing surfaces of adjacent ceramic washers.

10. Structure according to claim 7 wherein said coolant flow channels extend through said washers from within said airfoil portion to the exterior thereof in a random arrangement.

* * * * *